US010608367B2

(12) United States Patent
Yuan et al.

(10) Patent No.: US 10,608,367 B2
(45) Date of Patent: Mar. 31, 2020

(54) ELECTRICAL CONNECTOR AND FIXING BENDING MEMBER THEREOF

(71) Applicant: AVIC JONHON OPTRONIC TECHNOLOGY CO., LTD, Henan (CN)

(72) Inventors: Junfeng Yuan, Henan (CN); Min Zhang, Henan (CN); Guoqi Zhou, Henan (CN)

(73) Assignee: AVIC JONHON OPTRONIC TECHNOLOGY CO., LTD, Henan (CN)

( * ) Notice: Subject to any disclaimer, the term of this patent is extended or adjusted under 35 U.S.C. 154(b) by 0 days.

(21) Appl. No.: 16/078,011

(22) PCT Filed: Mar. 21, 2017

(86) PCT No.: PCT/CN2017/077477
§ 371 (c)(1),
(2) Date: Aug. 15, 2018

(87) PCT Pub. No.: WO2018/018899
PCT Pub. Date: Feb. 1, 2018

(65) Prior Publication Data

US 2019/0260152 A1 Aug. 22, 2019

(30) Foreign Application Priority Data

Jul. 29, 2016 (CN) ..... 2016 1 0610605

(51) Int. Cl.
*H01R 12/72* (2011.01)
*H01R 13/648* (2006.01)
(Continued)

(52) U.S. Cl.
CPC ..... *H01R 13/514* (2013.01); *H01R 9/2408* (2013.01); *H01R 12/724* (2013.01); *H01R 13/518* (2013.01); *H01R 12/58* (2013.01)

(58) Field of Classification Search
CPC ... H01R 13/502; H01R 13/514; H01R 13/648
See application file for complete search history.

(56) References Cited

U.S. PATENT DOCUMENTS 6,238,245 B1 5/2001 Stokoe et al.
6,692,305 B2 * 2/2004 Nelson ..... H01R 13/518 439/607.07
(Continued)

FOREIGN PATENT DOCUMENTS

CN 1539184 10/2004
CN 1610991 4/2005
(Continued)

OTHER PUBLICATIONS

"International Search Report (Form PCT/ISA/210)", dated Jul. 10, 2017, with English translation thereof, pp .1-4.

*Primary Examiner* — Xuong M Chung Trans
(74) *Attorney, Agent, or Firm* — JCIPRNET

(57) ABSTRACT

The present invention relates to the field of connectors, and in particular to an electrical connector and a fixing bending member thereof. The electrical connector includes a contact with a front end being a plugging end and at least two contact mounting plates arranged left and right in parallel and extending along forward and backward directions, and further includes a fixing bending member for fixing the contact mounting plates. The fixing bending member includes a first portion for fixing onto the top of the electrical connector, a second portion for fixing at a tail portion of the electrical connector and a connecting portion connecting the first and second portions. The first portion and the second portion extend toward the same side of the connecting
(Continued)

portion. The connecting portion is provided on the top of the electrical connector. The top of the electrical connector is provided with a top recessed slot for the insertion and fixation of the first portion such that the first portion is fixed onto the top of the electrical connector, or the connecting portion is provided at the tail portion of the electrical connector. The tail portion of the electrical connector is provided with a tail recessed slot for the insertion and fixation of the second portion such that the second portion is fixed to the tail of the electrical connector. The problem that a contact insulation mounting plate of an existing electrical connector is easily deformed is solved.

9 Claims, 4 Drawing Sheets

(51) Int. Cl.

| | |
|---|---|
| ***H01R 13/514*** | (2006.01) |
| ***H01R 13/518*** | (2006.01) |
| ***H01R 9/24*** | (2006.01) |
| *H01R 12/58* | (2011.01) |

(56) References Cited

U.S. PATENT DOCUMENTS

| | | | | |
|---|---|---|---|---|
| 7,497,736 | B2 * | 3/2009 | Minich | H01R 24/30 439/607.05 |
| 7,503,804 | B2 * | 3/2009 | Minich | H01R 12/585 439/607.05 |
| 7,682,193 | B2 | 3/2010 | Stoner | |
| 8,083,553 | B2 * | 12/2011 | Manter | H01R 13/514 439/701 |
| 8,366,485 | B2 * | 2/2013 | Johnescu | H01R 13/514 439/607.07 |
| 8,475,209 | B1 * | 7/2013 | Whiteman, Jr. | H01R 12/724 439/607.07 |
| 2008/0146046 | A1 | 6/2008 | Minich | |
| 2013/0280957 | A1 | 10/2013 | Davis et al. | |
| 2014/0051294 | A1 * | 2/2014 | Miller | H01R 13/26 439/625 |

FOREIGN PATENT DOCUMENTS

| | | |
|---|---|---|
| CN | 2749079 | 12/2005 |
| CN | 101494336 | 7/2009 |
| CN | 201285845 | 8/2009 |
| CN | 102208723 | 10/2011 |
| CN | 202034538 | 11/2011 |
| CN | 102882097 | 1/2013 |
| CN | 202940374 | 5/2013 |
| CN | 104167620 | 11/2014 |
| CN | 106252968 | 12/2016 |

* cited by examiner

ELECTRICAL CONNECTOR AND FIXING BENDING MEMBER THEREOF

CROSS-REFERENCE TO RELATED APPLICATION

This application is a 371 application of an international PCT application serial no. PCT/CN2017/077477, filed on Mar. 21, 2017, which claims priority to and the benefit of China Patent Application No. CN201610610605.1, filed on Jul. 29, 2016. The entirety of each of the abovementioned patent applications is hereby incorporated by reference herein and made a part of this specification.

BACKGROUND OF THE INVENTION

1. Field of the Invention

The present invention relates to the field of connectors, and in particular to an electrical connector and a fixing bending member thereof.

2. Description of Related Art

An existing differential electrical connector comprises at least two signal modules arranged left and right in parallel, each signal module comprises a contact mounting plate and a bent contact arranged on the contact mounting plate, one end of the bent contact is a plugging end while the other end of the bent contact is a welding foot which is used for welding to a printed board, a front side surface of the differential connector is a contact plugging end mounting surface for arrangement of the plugging end of the bent contact, a lower side surface of the differential connector is a welding foot mounting surface for arrangement of the welding foot of the bent contact, the contact plugging end mounting surface is adjacent to the welding foot mounting surface, a rear side surface of the differential connector is provided with a straight fixing plate for fixing the adjacent signal modules, each signal module further comprises a contact insulation mounting plate for mounting the bent contact, the contact insulation mounting plates of the adjacent signal modules are fixed together through fixing plates, for example, an electrical connector is disclosed in a Chinese patent having a publication number of CN104167620A and a publication date of Nov. 26, 2014, a front end of the electrical connector is a plugging end, the electrical connector comprises eight plug hole modules and the eight plug hole modules are arranged in parallel, a rear end of each plug hole module is fixed by an arranged straight fixing plate, each plug hole module comprises a ground plate, an insulator which is a contact mounting plate, an insulation cover plate and a contact, each contact is arranged on the contact mounting plate, and each ground plate is sandwiched between the insulation cover plate and the contact mounting plate. One end of the bent contact is a plugging end while the other end of the bent contact is a welding foot to be welded to the printed board, a front portion of the electrical connector is a plugging end, a lower side surface of the electrical connector is provided with a welding foot mounting surface for arrangement of the welding foot of the bent contact, a tail portion of the differential connector is provided with straight fixing plate for fixing the adjacent contact mounting plates, during assembling of the contact mounting plates, clamping blocks on the various contact mounting plates are clamped through clamping grooves formed in the straight fixing plate, thus, the contact insulation mounting plates arranged left and right are fixed, but the mode of fixing single surfaces of the contact mounting plates by the straight fixing plate is not firm, the contact insulation mounting plates are deformed easily, and relative positions of the various contact insulation mounting plates are ensured difficultly.

SUMMARY OF THE INVENTION

The present invention is directed to an electrical connector so as to solve the problem that contact insulation mounting plates of an existing electrical connector are deformed easily; and moreover, the present invention is also directed to a fixing bending member used for the electrical connector.

In order to achieve the abovementioned purposes, the electrical connector of the present invention adopts the technical scheme that the electrical connector comprises a contact with a front end being a plugging end and at least two contact mounting plates arranged left and right in parallel and extending along forward and backward directions, and further comprises a fixing bending member for fixing the contact mounting plates, the fixing bending member comprises a first portion for fixing onto a top of the electrical connector, a second portion for fixing at a tail portion of the electrical connector and a connecting portion connecting the first and second portions, and the first portion and the second portion extend toward the same side of the connecting portion; the connecting portion is provided on the top of the electrical connector, the top of the electrical connector is provided with a top recessed slot for inserting and fixing the first portion such that the first portion is fixed onto the top of the electrical connector, or the connecting portion is provided at the tail portion of the electrical connector, and the tail portion of the electrical connector is provided with a tail recessed slot for inserting and fixing the second portion such that the second portion is fixed to the tail of the electrical connector.

The connecting portion is provided on the top of the electrical connector, and the top of the electrical connector is provided with the top recessed slot for inserting and fixing the first portion such that the first portion is fixed onto the top of the electrical connector.

The first portion is pressed on a front side surface or a rear side surface of the top recessed slot.

The first portion is pressed on the rear side surface of the top recessed slot tightly, and the second portion is pressed on an end surface of the tail portion of the electrical connector tightly such that the fixing bending member is clamped on the contact mounting plates.

Top clamping blocks which are positioned in the top recessed slot are respectively arranged on the various contact mounting plates, the first portion is provided with first portion inserting fingers which correspond to the top clamping blocks, and first portion slots which tightly clamp the top clamping blocks are formed between the adjacent first portion inserting fingers; and tail clamping blocks which are positioned at the tail portion of the electrical connector are respectively arranged on the various contact mounting plates, the second portion is provided with second portion inserting fingers which correspond to the tail clamping blocks, and second portion slots which tightly clamp the tail clamping blocks are formed between the adjacent second portion inserting fingers.

Top slots which are clamping fitting with the first portion inserting fingers are formed between the adjacent top clamping blocks and/or tail slots which are clamping fitting with the second portion inserting fingers are formed between the adjacent tail clamping blocks.

The first inserting fingers and the second inserting fingers are provided with bumps which are clamping fitting with the clamping blocks.

The contact comprises a plugging portion and a mounting portion which is positioned at a rear of the plugging portion and the mounting portion is horizontal, an upward bent flange is arranged at the position of a front tip of the plugging portion, a front contact portion which is in contact with an adaptive contact is formed on a lower side surface of the bend of the upward bent flange, a recess which is recessed downwards relative to a rear end of the plugging portion is formed between the plugging portion and the mounting portion, a rear contact portion of the contact is formed by the recess, and the plugging portion is gradually downwards inclined from back to front from the connecting position between the plugging portion and the recess.

In order to achieve the abovementioned purposes, the fixing bending member of the present invention adopts the technical scheme that the fixing bending member comprises a first portion for fixing onto a top of the electrical connector, a second portion for fixing at a tail portion of the electrical connector and a connecting portion connecting the first and second portions, and the first portion and the second portion extend towards the same side of the connecting portion.

The first portion is provided with first portion inserting fingers which correspond to top clamping blocks, and first portion slots which tightly clamp the top clamping blocks are formed between the adjacent first portion inserting fingers; the second portion is provided with second portion inserting fingers which correspond to tail clamping blocks, and second portion slots which tightly clamp the tail clamping blocks are formed between the adjacent second portion inserting fingers; or the first portion is provided with the first portion inserting fingers which correspond to the tail clamping blocks, and the first portion slots which tightly clamp the tail clamping blocks are formed between the adjacent first portion inserting fingers; and the second portion is provided with the second portion inserting fingers which correspond to the top clamping blocks, and the second portion slots which tightly clamp the top clamping blocks are formed between the adjacent second portion inserting fingers.

The present invention has the beneficial effects that the electrical connector comprises the fixing bending member which is used for fixing the adjacent contact mounting plates, the first portion and the second portion extend towards the same side of the connecting portion, the connecting portion is provided on the top of the electrical connector, the top of the electrical connector is provided with the top recessed slot for inserting and fixing the first portion such that the first portion is fixed onto the top of the electrical connector, or the connecting portion is provided at the tail portion of the electrical connector, the tail portion of the electrical connector is provided with a tail recessed slot for inserting and fixing the second portion such that the second portion is fixed at the tail of the electrical connector. By fixing the first portion and the second portion of the fixing bending member onto the top of the electrical connector and at the tail portion of the electrical connector, the two surfaces of the electrical connector are fixed, fixed surfaces of the top and the tail portion of the electrical connector together ensure that the adjacent contact mounting plates are not deformed easily, compared with a fixing plate which is only arranged on the front end surface of an existing electrical connector, the fixing bending member of the electrical connector of the present invention fixes the top and the tail portion of the electrical connector, furthermore, the first portion is fixed in the top recessed slot or the second portion is fixed in the tail recessed slot to ensure firmness degree of fixation, thus, the adjacent contact mounting plates are not deformed easily, and the problem that existing adjacent contact insulation mounting plates relatively move easily is solved.

DESCRIPTION OF THE EMBODIMENTS

Embodiments of the present invention are further illustrated in combination with the following drawings.

Figure 1:
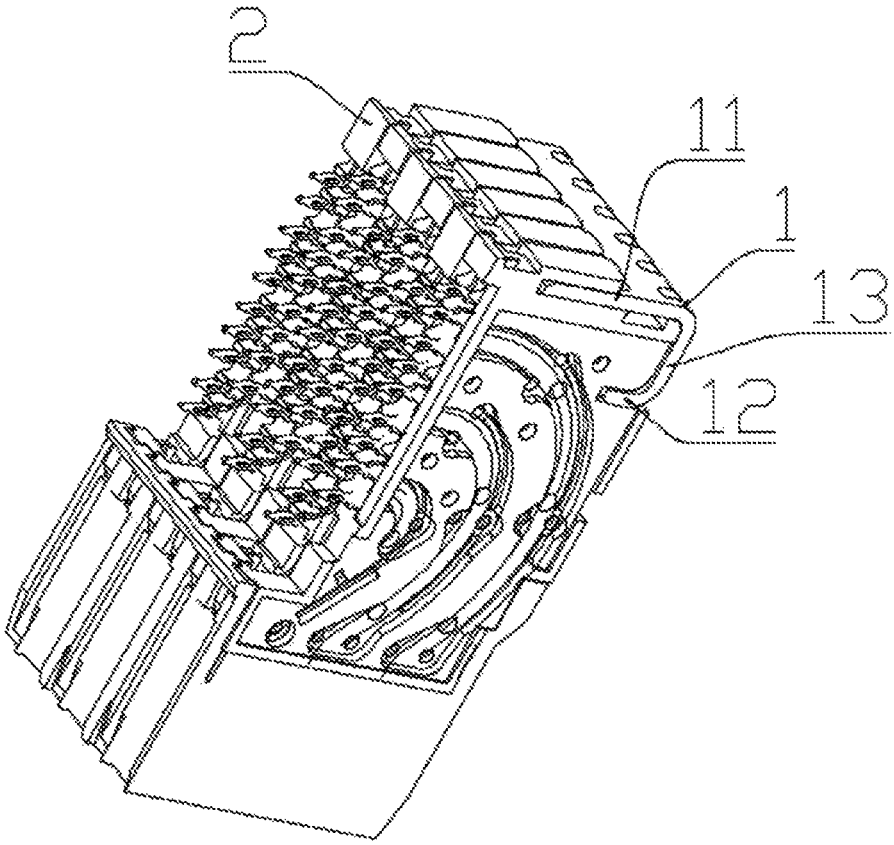
FIG. 1 is a structural diagram of an embodiment 1 of an electrical connector of the present invention.
Figure 2:
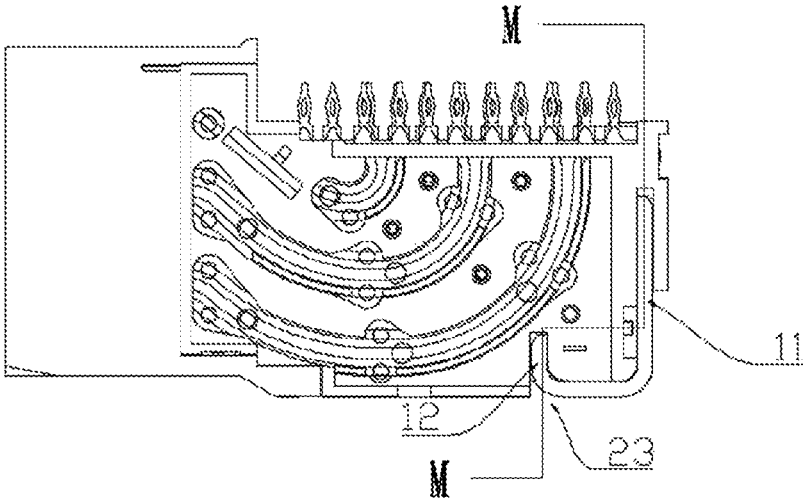
FIG. 2 is a front view of the embodiment 1 of the electrical connector of the present invention.
Figure 3:
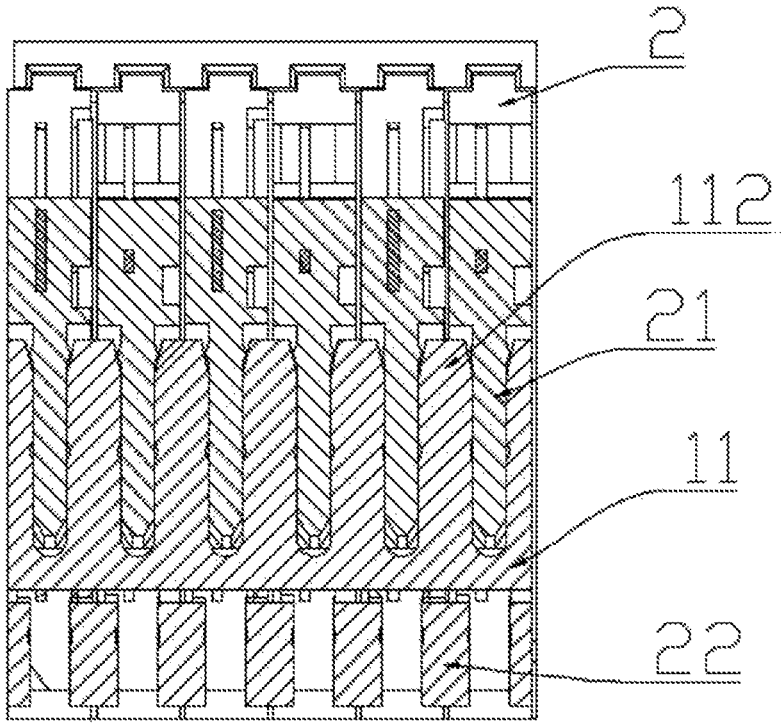
FIG. 3 is a sectional view taken along line M-M of FIG. 2.
Figure 4:
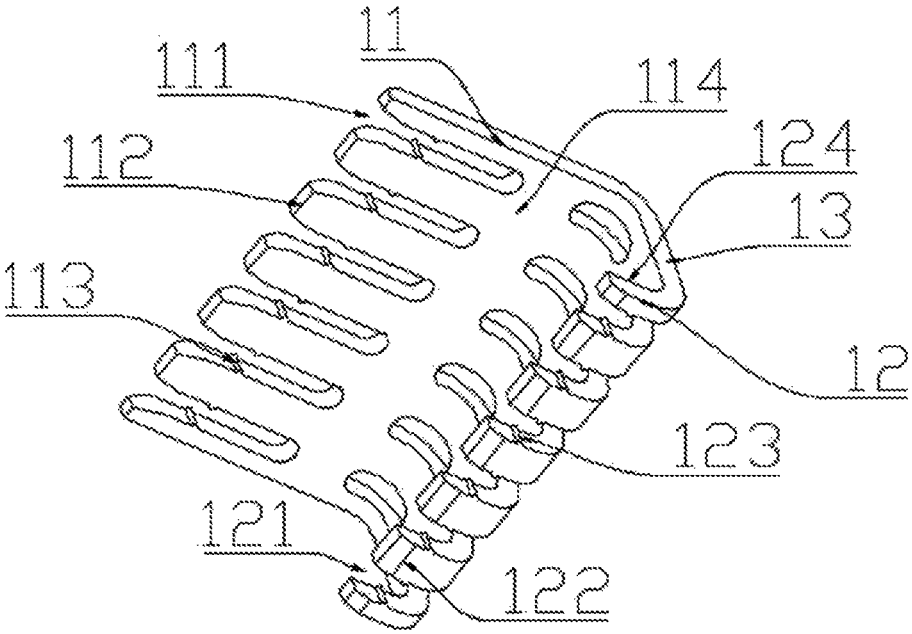
FIG. 4 is a structural diagram of a fixing plate of the embodiment 1 of the electrical connector of the present invention.
Figure 5:
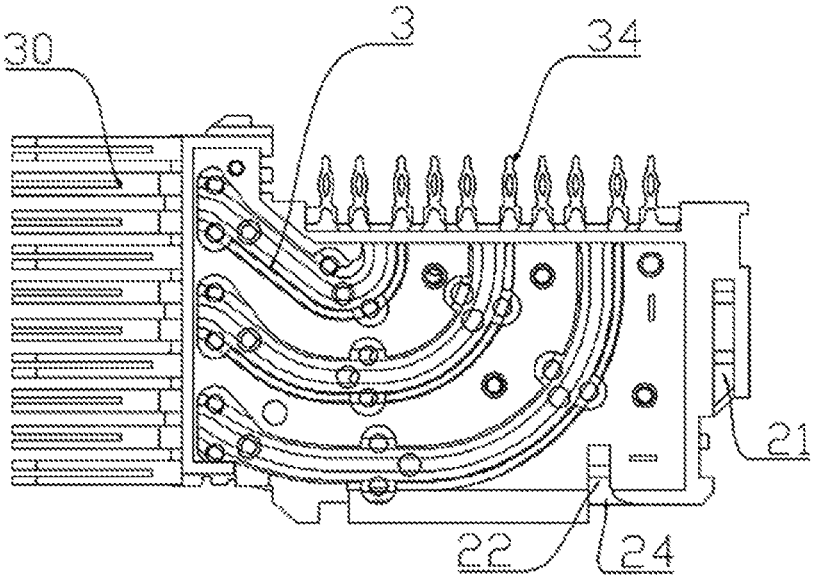
FIG. 5 is a front view of a contact fixing plate of the embodiment 1 of the electrical connector of the present invention.
Figure 6:
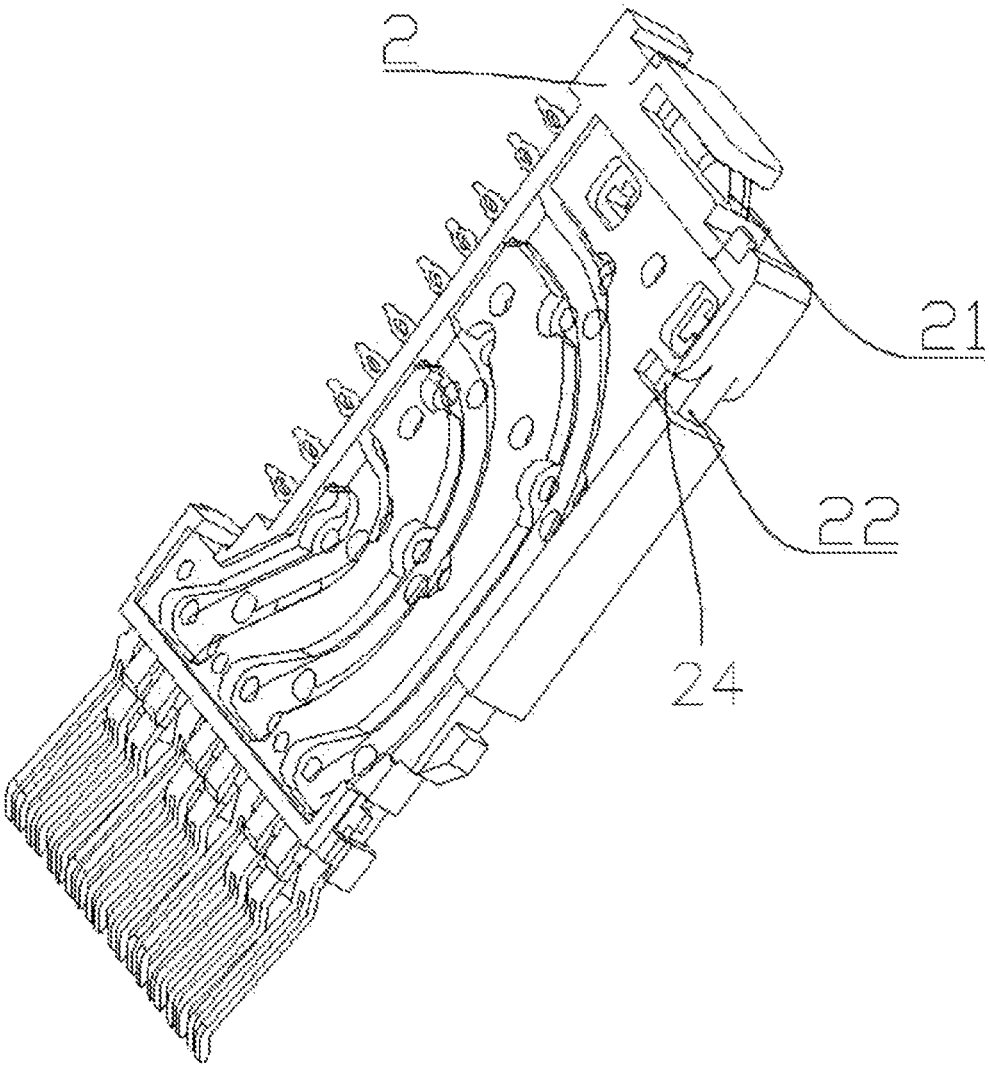
FIG. 6 is an isometric view of the contact fixing plate of the embodiment 1 of the electrical connector of the present invention.
Figure 7:
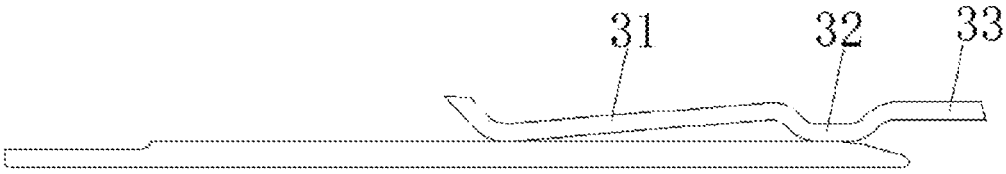
FIG. 7 is a structural diagram of a bent contact of the embodiment 1 of the electrical connector of the present invention.

According to an embodiment 1 of the electrical connector of the present invention as shown in FIG. 1 to FIG. 7, the electrical connector comprises six signal modules which are arranged left and right in parallel, each signal module comprises a bent contact 3 and contact mounting plates 2 for mounting the bent contact 3, and one end of the bent contact 3 is a welding foot 34 used for welding to a printed board while the other end of the bent contact 3 is a plugging end 30. A front end of the electrical connector is the plugging end, a front end surface of the electrical connector is a contact plugging end mounting surface for arrangement of the plugging end of the bent contact, and a bottom surface of the electrical connector is a welding foot mounting surface for mounting the welding foot of the bent contact.

The electrical connector further comprises a fixing bending member 1 which is clamped on contact mounting plates to fix the contact mounting plates, in the embodiment, the fixing bending member has a platy structure, and comprises a first portion 12 fixed onto a top of the electrical connector, a second portion 11 fixed at a tail portion of the electrical connector and a connecting portion 13 connecting the first and second portions, and the first portion and the second portion extend toward the same side of the connecting portion. The connecting portion is provided on the top of the electrical connector, the top of the electrical connector is provided with a top recessed slot for inserting and fixing the first portion, and the first portion is inserted and fixed in the top recessed slot such that the first portion is fixed onto the top of the electrical connector.

In the embodiment, the first portion and the second portion are relatively parallel along a vertical direction, and the length of the first portion is smaller than that of the second portion to prevent the top recessed slot from intervening in the bent contact in the electrical connector. The second portion 11 is provided with a second portion inner side surface 114 which is close to the first portion 12, the first portion 12 is provided with a first portion inner side surface 124 which is close to the second portion, and the second portion inner side surface 114 is in pressing fit with a rear end surface of the electrical connector.

An end of the second portion 11, which is away from the connecting portion 13, is provided with U-shaped second portion slots 111 which are arranged left and right in parallel, tail clamping blocks 21 which are tightly clamped by the second portion slots 111 are arranged on a rear side surface of the tail portion of the electrical connector, and the tail clamping blocks 21 are in one-to-one correspondence to the second portion slots 111, and are arranged in the middles of front end surfaces of the contact mounting plates along left and right directions. Second portion inserting fingers 112 are formed by slot walls between the adjacent second portion slots, and a second portion inserting finger groove which allows the second portion inserting finger to be inserted in and tightly clamps the second portion inserting finger is formed between each two adjacent tail clamping blocks 21.

A rear side of the top recessed slot 23 is provided with a recessed slot rear side surface which is pressed on the first portion inner side surface 124, the first portion 12 of the fixing bending member 1 is inserted in the top recessed slot 23, and the second portion 11 and the first portion 12 are clamped on the contact mounting plates. The second portion 11 is in pressing fit with an end surface of the tail of the electrical connector, the first portion 12 is in pressing fit with a rear side surface of the top recessed slot 23, therefore, the fixing bending member 1 is clamped on the contact mounting plates 2, and the purpose of fixing the contact mounting plates is achieved.

The first portion 12 of the fixing bending member 1 is provided with U-shaped first portion slots 121 arranged left and right in parallel, each first portion inserting finger 122 is formed by slot wall between the two adjacent first portion slots 121, and top clamping blocks 22 which are in one-to-one correspondence to the first portion slots 121 and are in clamping fit with the first portion slots 121 are arranged in the top recessed slot 23. In the present embodiment, the top recessed slot 23 is formed by combining contact mounting plate grooves 24 formed in upper end surfaces of the various contact mounting plates, each top clamping block 22 is arranged in the contact mounting plate groove 24, each first portion inserting finger groove 121 which allows the first portion inserting finger 122 to be inserted in is formed between the top clamping blocks 22 in each two adjacent contact mounting grooves 24, and each first portion inserting finger 122 is tightly clamped in the first portion inserting finger groove 121. A flaring structure for facilitating insertion of the tail clamping block is arranged at a groove of each second portion slot, and a flaring structure for facilitating insertion of the top clamping block is also arranged at a groove of each first portion slot. First bumps 113 which extend along forward and backward directions and are in clamping fit with the tail clamping blocks are separately arranged on the left side walls and the right side walls of the second portion slots. Second bumps 123 which extend along forward and backward directions and are in clamping fit with the top clamping blocks are separately arranged on the left side walls and the right side walls of the first portion slots.

The front end of the bent contact is a plugging end, the bent contact comprises a plugging portion 31, a recess 32 and a mounting portion 33 which is positioned at the rear of the plugging portion and is horizontal, and the plugging portion 31, the recess 32 and the mounting portion 33 are successively arranged from front to back. An upward bent flange which is formed by bending upwards is arranged at the position of a front end of the plugging portion 31, a front contact portion which is in contact with an adaptive contact is formed on a lower side surface of the bend of the upward bent flange, in the present embodiment, the recess 32 is U-shaped and is recessed downwards relative to a rear end of the plugging portion 31, a rear contact portion of the contact is formed by a lower side surface of the recess, the mounting portion 33 is horizontally positioned at a rear end of the recess 32, the plugging portion 31 is gradually downwards inclined from back to front from a position of the plugging portion 31 connecting with the recess 32, and in the present embodiment, the front contact portion and the rear contact portion are positioned on the same horizontal plane. During use, the front contact portion can be elastically in contact with a root portion of the adaptive contact, the rear contact portion can be elastically in contact with an end of the adaptive contact, therefore, a cantilever structure of the adaptive contact is eliminated or shortened, and the insertion loss of the connector is relieved.

The second portion of the fixing bending member of the electrical connector of the present invention is in pressing fit with the rear end surface of the electrical connector, the first portion is in pressing fit with the rear side surface of the recessed slot such that the fixing bending member is clamped onto the electrical connector through the second portion and the first portion, it can be ensured that the contact mounting plates of the electrical connector cannot move relatively in a staggered manner in a forward and backward directions, meanwhile, the second portion slots formed in the second portion tightly clamp the tail clamping blocks on the rear end surface of the electrical connector in a left-right direction, and thus, it can be ensured that the contact mounting plates and the fixing bending member cannot move left and right relatively. Compared with a single-surface fixing bending member which is used for fixing contact mounting plates of an existing electrical connector, the fixing bending member of the present invention has the characteristics that the area of a portion of the fixing bending member, which is in contact with the contact mounting plates of the electrical connector, is increased, furthermore, the firmness degree of fixation of the fixing bending member to the contact mounting plates is increased, the first portion and the second portion of the fixing bending member are fixed onto the top of the electrical connector and at the tail portion of the electrical connector, the first portion is fixed in the top recessed slot, firmness degree of fixation is ensured, fixation of the two surfaces of the electrical connector is implemented, the first portion, the second portion and the connecting portion of the fixing bending member are cooperative, and thus, it can be ensured that the adjacent contact mounting plates are not deformed easily. In addition, a fixing plate of the existing electrical connector requires to be provided with a certain clearance travel for accommodating the tail clamping blocks in a vertical direction, the fixing plate needs to be inserted horizontally and then is vertically pushed by a distance for fixation, when being used, the fixing bending member of the present invention can be directly inserted from the top of the electrical connector, size minimization is realized, and the clearance travel in the vertical direction is not required.

Compared with the embodiment 1, an embodiment 2 of the electrical connector of the present invention only has the following differences: a connecting portion is provided at the tail portion of the electrical connector, a top recessed slot does not exist, a first portion and top clamping blocks arranged on the end surface of the top of the electrical connector are clamped tightly, but the tail portion of the electrical connector is provided with a tail recessed slot, and tail clamping blocks are arranged in the recessed slot.

Compared with the embodiment 1, an embodiment 3 of the electrical connector of the present invention only has the following differences: top clamping blocks are not arranged in a top recessed slot, but a first portion is pressed against the inside of the top recessed slot such that the first portion is fixed on the top of the electrical connector, and the first portion can be pressed against the front side surface or the rear side surface of the top recessed slot.

According to an embodiment of the fixing bending member of the present invention, the structure of the fixing bending member is the same as that of the fixing bending member in the embodiment 1 or the embodiment 2 or the embodiment 3 of the electrical connector, and the descriptions thereof are omitted herein.

In other embodiments of the electrical connector and the fixing bending member thereof in the present invention, the bumps arranged in the first portion slots and the second portion slots can be omitted, bump structures can be additionally arranged on the surface of a lug, wherein the surface of the lug is in clamping fit with an inserting slot, or the first portion slots and the second portion slots are in interference fit with the clamping blocks in notch; and the top clamping blocks can correspond to two first portion inserting fingers, at the moment, the first portion slots between the two first portion inserting fingers may not be arranged left and right in parallel, but a certain spacing distance may be reserved in a front-back direction.

What is claimed is:

1. An electrical connector, comprising a contact with a front end being a plugging end and at least two contact mounting plates arranged left and right in parallel and extending along forward and backward directions, the electrical connector further comprises a fixing bending member for fixing the contact mounting plates, the fixing bending member comprises a first portion for fixing onto a top of the electrical connector, a second portion for fixing at a tail portion of the electrical connector and a connecting portion connecting the first and second portions, and the first portion is substantially parallel to the second portion; the connecting portion is provided on the top of the electrical connector, the top of the electrical connector is provided with a top recessed slot for inserting and fixing the first portion such that the first portion is fixed onto the top of the electrical connector, wherein the first portion is pressed tightly on a rear side surface of the top recessed slot, and the second portion is pressed tightly on an end surface of the tail portion of the electrical connector such that the fixing bending member is inserted to the electrical connector from the top of the electoral connector in a direction substantially perpendicular to a plug-in direction of the plugging end and is clamped on the contact mounting plates.

2. The electrical connector according to claim 1, wherein top clamping blocks which are positioned in the top recessed slot are respectively arranged on the various contact mounting plates, the first portion is provided with first portion inserting fingers which correspond to the top clamping blocks, and first portion slots which tightly clamp the top clamping blocks are formed between the adjacent first portion inserting fingers; and tail clamping blocks which are positioned at the tail portion of the electrical connector are respectively arranged on the various contact mounting plates, the second portion is provided with second portion inserting fingers which correspond to the tail clamping blocks, and second portion slots which tightly clamp the tail clamping blocks are formed between the adjacent second portion inserting fingers.

3. The electrical connector according to claim 2, wherein top slots which are clamping fitting with the first portion inserting fingers are formed between the adjacent top clamping blocks and/or tail slots which are clamping fitting with the second portion inserting fingers are formed between the adjacent tail clamping blocks.

4. The electrical connector according to claim 3, wherein the first inserting fingers and the second inserting fingers are provided with bumps which are clamping fitting with the clamping blocks.

5. The electrical connector according to claim 1, wherein the contact comprises a plugging portion and a mounting portion which is positioned at the rear of the plugging portion and the mounting portion is horizontal, an upward bent flange is arranged at a front tip of the plugging portion, a front contact portion which is in contact with an adaptive contact is formed on a lower side surface of a bend of the upward bent flange, a recess which is recessed downwards relative to a rear end of the plugging portion is formed between the plugging portion and the mounting portion, a rear contact portion of the contact is formed by the recess, and the plugging portion is gradually downwards inclined from back to front from the connecting position between the plugging portion and the recess.

6. The electrical connector according to claim 1, wherein tail clamping blocks which are positioned in the tail recessed slot are respectively arranged on the various contact mounting plates, the second portion is provided with second portion inserting fingers which correspond to the tail clamping blocks, and second portion slots which tightly clamp the tail clamping blocks are formed between the adjacent second portion inserting fingers; and top clamping blocks which are positioned on the top of the electrical connector are respectively arranged on the various contact mounting plates, the first portion is provided with first portion inserting fingers which correspond to the top clamping blocks, and first portion slots which tightly clamp the top clamping blocks are formed between the adjacent first portion inserting fingers.

7. The electrical connector according to claim 1, wherein tail clamping blocks which are positioned in the tail recessed slot are respectively arranged on the various contact mounting plates, the second portion is provided with second portion inserting fingers which correspond to the tail clamping blocks, and second portion slots which tightly clamp the tail clamping blocks are formed between the adjacent second portion inserting fingers; and top clamping blocks which are positioned on the top of the electrical connector are respectively arranged on the various contact mounting plates, the first portion is provided with first portion inserting fingers which correspond to the top clamping blocks, and first portion slots which tightly clamp the top clamping blocks are formed between the adjacent first portion inserting fingers.

8. A fixing bending member, comprising a first portion for fixing onto a top of an electrical connector, a second portion for fixing at a tail portion of the electrical connector and a connecting portion connecting the first and second portions, the first portion is substantially parallel to the second portion, wherein the connecting portion is provided on the top of the electrical connector, and the top of the electrical connector is provided with a top recessed slot for inserting and fixing the first portion such that the first portion is fixed onto the top of the electrical connector, wherein the first portion is pressed tightly on a rear side surface of the top recessed slot, and the second portion is pressed tightly on an end surface of the tail portion of the electrical connector such that the fixing bending member is inserted to the electrical connector from the top of the electoral connector in a direction substantially perpendicular to a plug-in direction of the plugging end and is clamped on the contact mounting plates.

9. The fixing bending member according to claim 8, wherein the first portion is provided with first portion inserting fingers which correspond to top clamping blocks, and first portion slots which tightly clamp the top clamping blocks are formed between the adjacent first portion inserting fingers; the second portion is provided with second portion inserting fingers which correspond to tail clamping blocks, and second portion slots which tightly clamp the tail clamping blocks are formed between the adjacent second portion inserting fingers; or the first portion is provided with first portion inserting fingers which correspond to the tail clamping blocks, and first portion slots which tightly clamp the tail clamping blocks are formed between the adjacent first portion inserting fingers; and the second portion is provided with second portion inserting fingers which correspond to the top clamping blocks, and second portion slots which tightly clamp the top clamping blocks are formed between the second portion inserting fingers.

* * * * *